US005727710A

United States Patent [19]

Severus et al.

[11] Patent Number: 5,727,710

[45] Date of Patent: Mar. 17, 1998

[54] GAS-TIGHT CONTAINER

[75] Inventors: Harald Severus, Schaffhausen; Andreas Ziegler, Stetten; Juris Walter, Schaffhausen, all of Switzerland

[73] Assignee: Alusuisse Technology & Management Ltd., Switzerland

[21] Appl. No.: 747,431

[22] Filed: Nov. 20, 1996

[30] Foreign Application Priority Data

Dec. 5, 1995 [CH] Switzerland ..... 03435/95

[51] Int. Cl.[6] ..... B65D 7/42

[52] U.S. Cl. ..... 220/609; 220/906

[58] Field of Search ..... 220/609, 606, 220/628, 635, 906

[56] References Cited

U.S. PATENT DOCUMENTS

| | | | |
|---|---|---|---|
| 3,043,461 | 7/1962 | Glassco | 220/609 X |
| 3,409,167 | 11/1968 | Blanchard . | |
| 3,904,069 | 9/1975 | Toukmanian | 220/609 |
| 4,125,632 | 11/1978 | Vosti et al. | 220/609 X |
| 4,147,271 | 4/1979 | Yamaguchi | 220/609 X |
| 4,426,013 | 1/1984 | Cherchian et al. | 220/609 |
| 4,542,029 | 9/1985 | Caner et al. | 220/609 X |
| 4,667,454 | 5/1987 | McHenry et al. . | |
| 4,880,129 | 11/1989 | McHenry et al. | 220/609 |

FOREIGN PATENT DOCUMENTS

| | | |
|---|---|---|
| 532675 | 11/1954 | Belgium . |
| 2256876 | 8/1975 | France . |
| 2723700 | 11/1978 | Germany . |
| 2269152 | 2/1994 | United Kingdom . |

*Primary Examiner*—Steven M. Pollard
*Attorney, Agent, or Firm*—Bachman & LaPointe, P.C.

[57] ABSTRACT

Gas-tight container featuring an outer shell of metal or metal and plastic or metal and cellulose-containing material, a base, a lid and at least one side-wall. The container may be e.g. a can with, as viewed in plan view, a polygonal, round or oval cross-section. The base or part of the base of the gas-tight container exhibits a region which may be made to bulge and which is surrounded by an endless depression and, in the condition in which the can may be used, is in the form of a concave bulge. A container of this kind is such that one can readily recognize if the contents have suffered from spoiling or decomposition and, as a consequence, gas has been formed inside the container. If the pressure inside the container increases, the bulge is pushed outwards and, usefully, may form a convex bulge. If the bulge is pushed out by the increase in internal pressure, it projects beyond the outer limits of the container base rim, as a result of which the linear or ring-shaped contact the base rim makes with an underlying surface changes to two point contact and the container indicates a chemical or physical change by its instability on an underlying surface.

13 Claims, 5 Drawing Sheets

GAS-TIGHT CONTAINER

BACKGROUND OF THE INVENTION

The present invention relates to a gas-tight container the base rim of which rests along a linear or ring-shaped line of contact, said container having an outer shell surface of metal or metal and plastic or metal and cellulose-containing material, and the outer shell surface comprises a base, lid and at least one side-wall and is such that it features at least one response area which is surrounded by an endless depression and, when the container is in the condition for use, is concave in shape. The invention also relates to the use of the container.

It is known to package goods which can decompose or degenerate in containers which are gas-right and radiation-proof and to close these containers in a gas-tight manner, this in order to protect them from harmful effects such as light, air, bacterial contamination, drying out, hygroscopic effects etc. Typical containers of this kind are food cans containing foodstuffs for human and animal consumption or beverage cans, also containers for pharmaceutical, cosmetic or medicinal products, cleaning agents, pesticides, and solvents, especially the biologically based variety, etc.

For example, if the contents of a container, for example a food can, are subject to microbial attack or chemical decomposition, gases may form there causing the pressure inside the can to increase. On opening such a can, this increase in pressure causes the gases to be forcibly ejected, in some cases also causing a sudden, undesired expression of the contents.

Apart from problems such as dirtying the surroundings or even injuring the person opening such a can, the user will be upset and annoyed at the manufacturer because the purchased goods are inedible or unusable, and he is faced with problems of returning and replacing the goods.

SUMMARY OF THE INVENTION

The object of the present invention is to offer a solution to these problems by means of which it is easy to see that the contents of a container have been subject to spoiling or decomposition.

That objective is achieved by way of the invention in that the response area is situated at the base of the container and the bulge there which is concave in the useable form of the container does not project beyond the outer limits of the base rim and, under increased pressure from within the can under normal external conditions, projects beyond the base rim, and viz., such that linear or ting-shaped contact the container makes with the underlying surface is replaced by two-point contact, and the resultant instability of the container indicates that its contents have undergone a chemical or physical change Under normal internal pressure the bulge in the container is advantageously concave and does not extend beyond the inner limits of the base rim and, under increased pressure, the concave bulge changes to a convex bulge which extends beyond the outer limits of the base rim.

The outer shell of the container comprising base, lid and one or more side-walls may e.g. be a can with, a polygonal, round or oval cross-section as seen in plan view. In keeping with the polygonal cross-section the can may exhibit a plurality of side-walls or, in the case of a round or oval cross-section, a single endless side-wall. The side-walls terminate in a base rim which may be formed e.g. by a flanged end, fold, joint or a simple kink or bend in the can shell. The base rim may form a linear or ring-shaped contact with a flat or smooth under-lying support surface.

In addition to the side-wall or side-walls the container may exhibit a base and a lid, the lid being formed by drawing the side-wall in to form a dome or, in the case of a polygonal cross-section, by the side-walls.

Other shapes of container are e.g. beakers, goblets, dishes, bottles, canisters or cans.

BRIEF DESCRIPTION OF THE DRAWINGS

The present invention is illustrated further by FIGS. 1 to 5 of an example which is a container in the form of a can.

DETAILED DESCRIPTION OF PREFERRED EMBODIMENTS

Figure 1A:
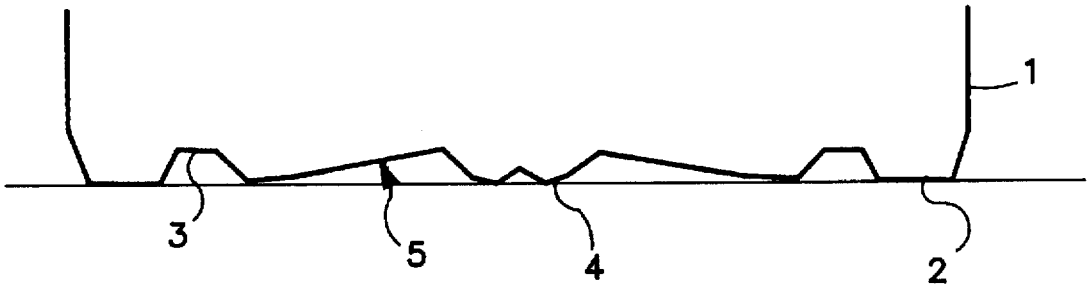
FIGS. 1*a*, 1*b* and 1*c* each show a cross-section through variously shaped can bases.

The material forming the container shell may e.g. be of metal such as steel, iron, tin, zinc, galvanized iron, copper, aluminum and its alloys, tin-plate etc. The metal is preferably prepared in the form of foils, strips or blank rounds; in the finished container the thickness of the material may be 10 to 400 μm thick. The metal may be coated on one or both sides with layers of metal such as e.g. tin; chromium; nickel or with plastic such as coatings, extrudates, films or film laminates and can therefore also be in the form of a composite material. The metal may also be coated on one or both sides with a cellulose-containing material such as paper, paper masche or cardboard. Further, it is possible for the metal to be coated on one side with the above mentioned cellulose-containing materials and on the other side with the above mentioned plastic layers. Preferred are container shells of metal. Suitable plastics are e.g. thermoplastics or duroplastics which may be reinforced with fillers or fibres, meshes or woven materials. The plastics may be of or contain polyvinylchlorides, polyolefins, polyamides, polycarbonates, polyesters, acrylnitrile, methacrylnitrile, styrene, copolymers of acrylnitrile and styrene, copolymers of acrylnitrile, styrene and butadiene, epoxy resins etc.

The various parts of the container may also be of different materials. For example, the side-wall may be of cellulose-based material combined with metal and the base and lid may be of plastic and metal.

Depending on the rigidity of the material, it may be advantageous for the bulge area which is surrounded by an endless depression to have a further endless depression associated with it. The further depression or a plurality thereof, e.g. 2,3,4,5 and 6 additional depressions may lie inside each other thereby forming concentric circles or ovals. Synonymous with the expression "depression" here is are embossments or recesses etc.

Further depressions or embossments may be provided running star-like outwards towards the edge of the container.

A single depression or one of the inner depressions, in particular the innermost depression, may delimit a projection or projection which with respect to the container is directed outwards. Such a projection or bulge or elevation may e.g. be in the form of a segment of a sphere, or a pyramid, a blunted pyramid, a cone or blunted cone.

Advantageously, the response region of a container according to the invention, which is surrounded by an endless depression, features at least one projection which in the useable form of the container does not extend beyond the outer limit of the edge of the base and, when the pressure inside the container is increased, extends beyond the outer limits of the container base rim. As a result of this, the linear or ring-shaped contact made by the rim of the container base changes to two-point contact, especially on a flat underlying surface.

Under conditions of excess pressure inside the container, the response area which in the useable form of the container is concave, springs outwards, i.e. the region which initially bulged to a greater or lesser extent towards the interior of the container may form a convex bulge or dome outwards. The expressions concave and convex refer to the view of someone looking at the outside of the container.

That part of the shell surface which exhibits a concave bulge is situated in the base or it forms the base itself which is concave. The concave bulge in the useable form of the container does not extend beyond the outer limits of the base rim of the container i.e. the container is stable standing on a linear or ting-shaped line of contact with a flat underlying surface. If the pressure inside the container rises, the concave bulge changes to a convex bulge and the convex bulge extends beyond the outer limits of the base rim. The linear or ring-shaped contact the container base rim makes especially with a flat substrate changes then in the case of a round base rim, to two-point contact and a container such as a cylindrical can tips at an angle and, even under the application of little force, rolls along the base rim. In the same way, a container with a polygonal shape will exhibit instead of the linear or ring-shaped contact a linear and point contact and the container will stand tilted on a flat substrate.

The result of this in practice is not only that there is a visual effect due to the outward bulging area, but also the fact that such containers are unstable on a flat surface, stand slightly tilted at an angle and begin to tilt further or rotate at the slightest touch. This effect is particularly effective e.g. with food cans containing foodstuffs for human or animal consumption. The inclination and in some cases the instability of such cans make them immediately obvious on shop shelves.

Containers according to the present invention may be manufactured in many ways. For example, cans may have a rounded or folded side-wall and in the side-wall one or more adhesively bonded, welded and/or ranged seam or seams. The base and lid may be cast, stamped shaped and thereafter bonded, welded, rolled-in or ranged to the ends of the side-wall. During the manufacturing process, the response area may e.g. be embossed into the base.

Other containers are e.g. made up of a side-wall out of composites containing plastics, plastic-paper, paper-metal foil or plastic-metal foil rolled into tube form, and the base and lid e.g. of metal with plastic.

Containers which find preference are of metal e.g. steel, tin-plate, chrome plated or nickel plated steel, aluminum etc. or laminates containing aluminum, steel and plastic layers. For example, blanks are stamped out of a metal strip. The blanks are shaped into dish-like preforms. the pre-forms are drawn through a series of rings using a stamp which features at its lower end a tool for shaping the base. Towards the end of the drawing operation the stamp strikes the die for shaping the base, as a result of which the material between the die and the stamping tool is accordingly contoured. One-piece cans are produced by stretch drawing and, after filling, only have to be fitted with a lid, for example a lid with a tear-open closure. The lid may e.g. be flanged, adhesively bonded or welded on. During the stretch drawing a contour with at least one depression may be formed in the base situated between the stamp and the die, as a result of which the base or a part thereof forms the response area.

A preferred version of the container according to the invention is such that the area which exhibits a concave bulge in the useable form is the base, the side-wall is shaped into a cylinder and the lid contains a mar-off closure.

The depth of the depression which delimits the response area and the number and depth of the depression in the response area may be selected according to the force required later in order to cause the concave bulge to be pressed outwards or to force the concave area to take on a convex shape.

In practice the shape of the response areas may be determined in trials and the limiting inner pressure required to change the bulge either smoothly or suddenly from concave to convex selected as required. This may be done by choosing the appropriate material, preferably steel sheet, an-plate, chromium plated or nickel plated steel sheet (tin free steel=IFS), aluminum, composites of metals and plastics or composites of metal and paper for wrapped cans and by choosing the appropriate thickness of material e.g., from 60 to 400 μm, in particular 80 to 300 μm. The depth of the depression may be e.g. 0.2 to 25 mm. The number of depressions may be e.g. 1, 2 or 3. The size of the response area may by preference be as large as the whole of the base area.

In gas-tight containers according to the invention the difference between the initial volume at which the response area is concave and the condition in which the response area is pushed out or forms a convex bulge and extends beyond the outer limits of the base rim under increased interior pressure and otherwise normal conditions may e.g. be up to 14 $cm^3$, usefully 0.5 to 12 $cm^3$, advantageously 1 to 10 $cm^3$ and particularly advantageously 2 to 5 $cm^3$.

By normal conditions is understood e.g. temperatures in the range of room temperature, i.e. 15 to 30° C., and ambient pressure, i.e. around 1 bar.

Containers are normally manufactured by shaping, possibly coating, filling and lidding in a gas-tight manner; further processing steps such as shaping the side-wall, fitting the base, filling and lidding etc. are likewise possible. After filling and before or in particular after lidding, the containers may be subjected to a sterilisation or pasteurisation treatment at temperatures of up to 130° C. or higher. Depending on whether the sterilization or pasteurization treatment is carried out with or without counterpressure, the internal pressure may increase due to an increase in volume resulting from the effect of heating. The response area may change from concave to convex. The tendency to spring-back on cooling will cause the response area to return to the concave form due to the accompanying reduction in volume. The same may occur under the influence of external heating such as the action of strong sunshine and the like.

If such a closed, gas-tight container is stored and, during storage, the contents undergo a chemical reaction or suffer microbial attack, such as spoiling or even fermentation causing gas to form, the pressure on the inside of the container will increase. As a result of this, the response area will change either smoothly or suddenly from a concave to convex form.

For example, if this occurs in the case of a metal can such as an aluminum can with a coating on the inside which does not offer sufficient protection or is damaged, and aggressive aqueous contents causes the corrosion via acidic or alkaline reaction, the aluminum is converted to aluminum oxide and oxygen is formed contributing to the pressure inside the can.

Fermentation of contents for consumption by humans or animals, may cause carbon dioxide to form and increase the pressure inside the container.

The present invention relates also to the use of the container in question for holding contents that undergo microbial and/or chemical decomposition.

A preferred application for these containers is for foodstuffs classified for human and animal consumption, especially such for in pasty or finely divided form.

These containers are suitable therefore e.g. for contents such as foodstuffs containing water with a pH value less than 5, such as freshly prepared mixed pickles, acids, non-carbonated or low-carbonated drinks, or fresh foods, meat preparations, ready-prepared foods, animal foodstuffs, such as preparations containing protein or starch in pasty or divided form with a pH value greater than 5 and cosmetic or pharmaceutical-medicinal products, cleansing agents, pesticides, fertilizers or other substances.

Figure 1B:
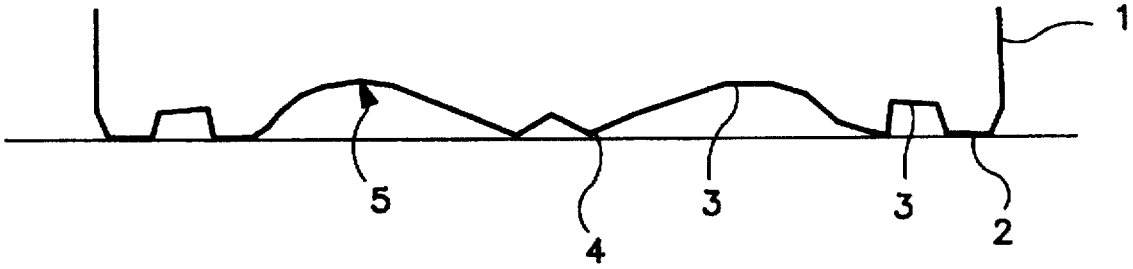
Figure 1C:
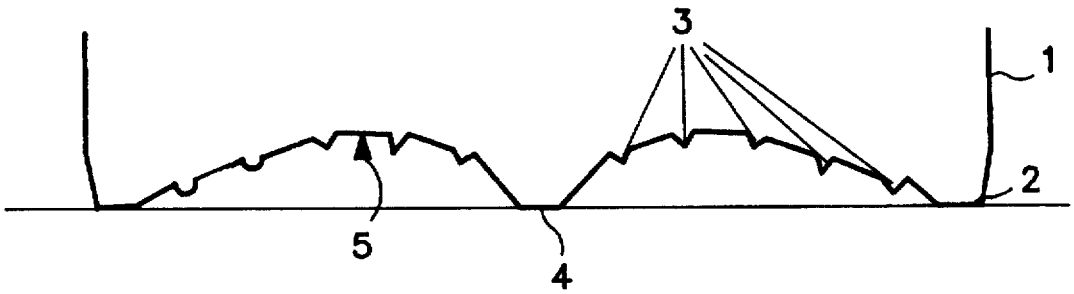

FIGS. 1*a*, 1*b* and 1*c* show by way of example various versions of can bases 5 which in the present case are shaped by stamping out a round blank, forming a dish-shaped pre-form and stretch drawing this into a one-piece can. The stretch drawing is performed using a stamping tool which shapes the actual can from the pre-form; an inlay for shaping the base is fitted to the base of the stamp and, in the last step of the stretch drawing process, the base of the stamping tool is pressed against the die for shaping the contour of the base, as a result of which the depression 3 and the projecting bulge 4 are formed.

FIGS. 1*a*, 1*b*, and 1*c* show the side-wall 1 of a can which meets the base at an edge or base rim 2 which at the same time forms the part of the base on which the can stands in the upright position. The base rim 2 represents the outer limit of the container base. Various integral depressions 3 with various buckle or bend radii are formed in the base; in the center of the base is a projecting area 4 which, in the present case with respect to a flat underlying substrate, does nor extend beyond the base rim 2. FIGS. 1*a* and 1*b* show relatively deep depressions and in the center of the base 5 the projection 4; in FIG. 1*c* there is a plurality of fine depressions 3 situated in a domed part of the base and the projection 4.

As the pressure inside the can increases, the can base 5 domes outwards and the projection 4 projects beyond the outer limit of the base formed by the base rim 2. As a result, the can stands inclined and, instead of making linear contact with a flat underlying surface along the whole of the base rim, the can stands on two points, which affects the stability or the ease with which the can is tilted.

Figure 2:
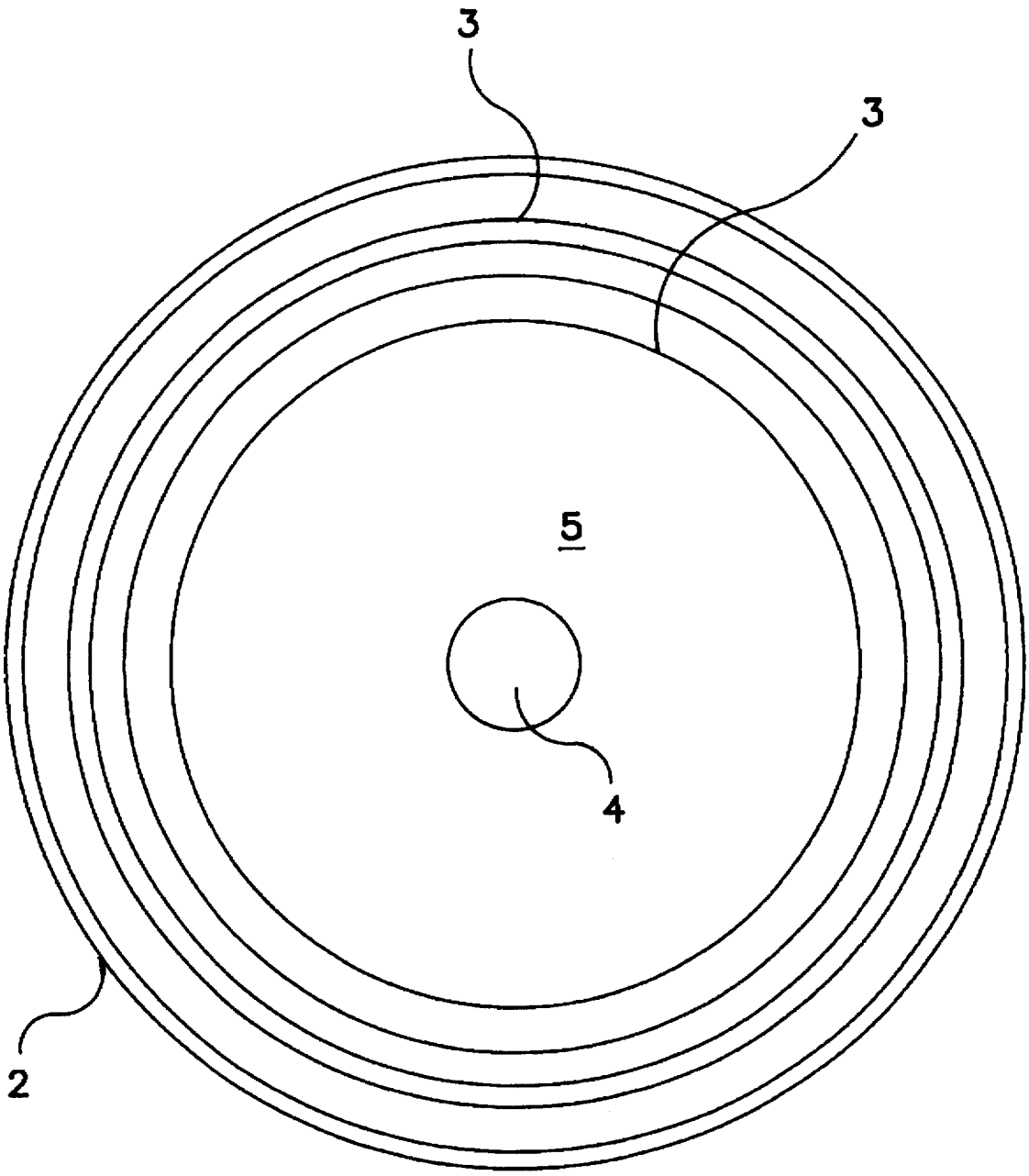
FIG. 2 shows the plan view of a can base.

FIG. 2 shows a plan view of a can base 5 in which again the base rim 2, the depression 3 and projection 4 are to be seen.

Figure 3A:
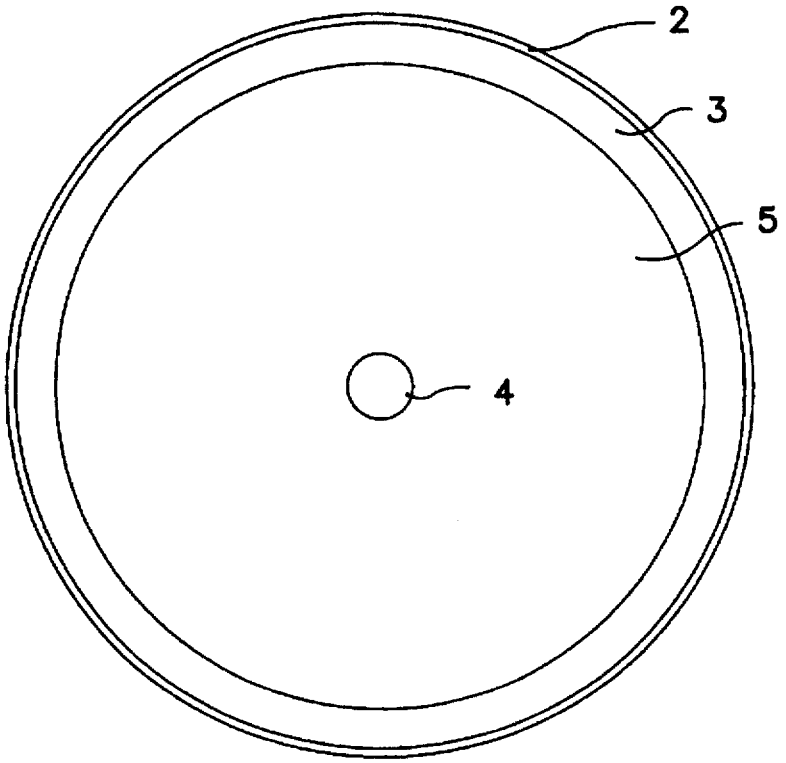
FIGS. 3*a*, 3*b* and 3*c* show the plan view of a can base and two cross-sections through the can base.
Figure 3B:
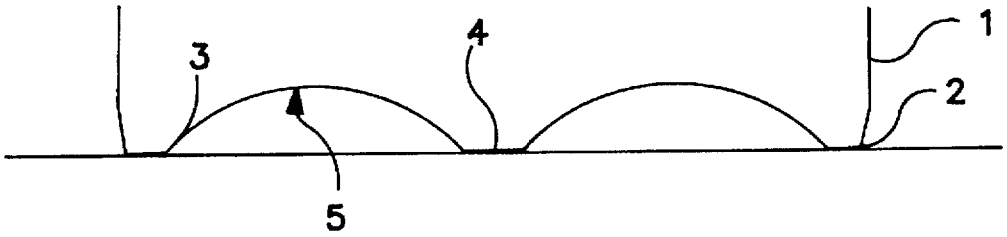
Figure 3C:
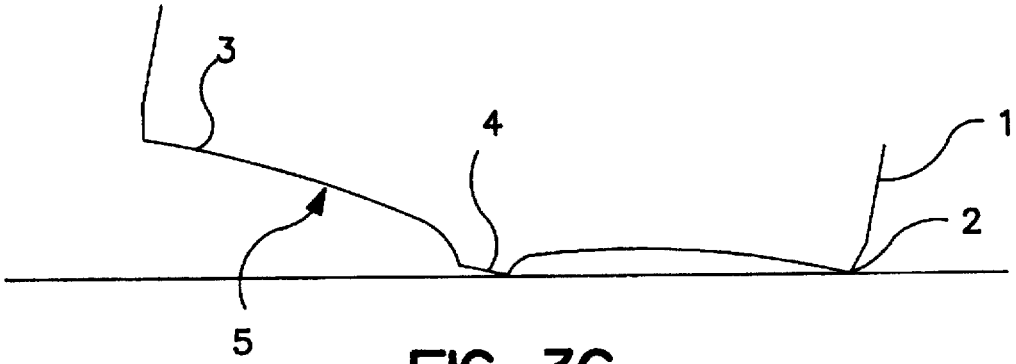

FIG. 3*a* shows a further version of a can base 5 in which a depression 3 is shown concentric to and within the base rim 2. FIG. 3*b* shows the can base 5 of FIG. 3*a* in cross-section, the side-wall 1 being delimited by the base rim 2. Concentric to the base rim 2 is the depression 3 and, forming a concave dome, the can base 5 continues to the center which is formed by the projection 4. The can is in the condition for using and both the base rim 2 and by way of example the projection 4 in the base 5 lie on a flat surface. In FIG. 3*c* the same can as in FIG. 3*b* is shown with side-wall 1 and base rim 2, however, as a result of the increase in internal pressure, the base 5 has been pushed out, at the same time undergoing deformation along the depression 3 and the base within the depression 3. The can now stands on the flat underlying surface only on the projection 4 and on one point of the base rim 2 i.e. the can stands inclined and unsteadily.

Figure 4:
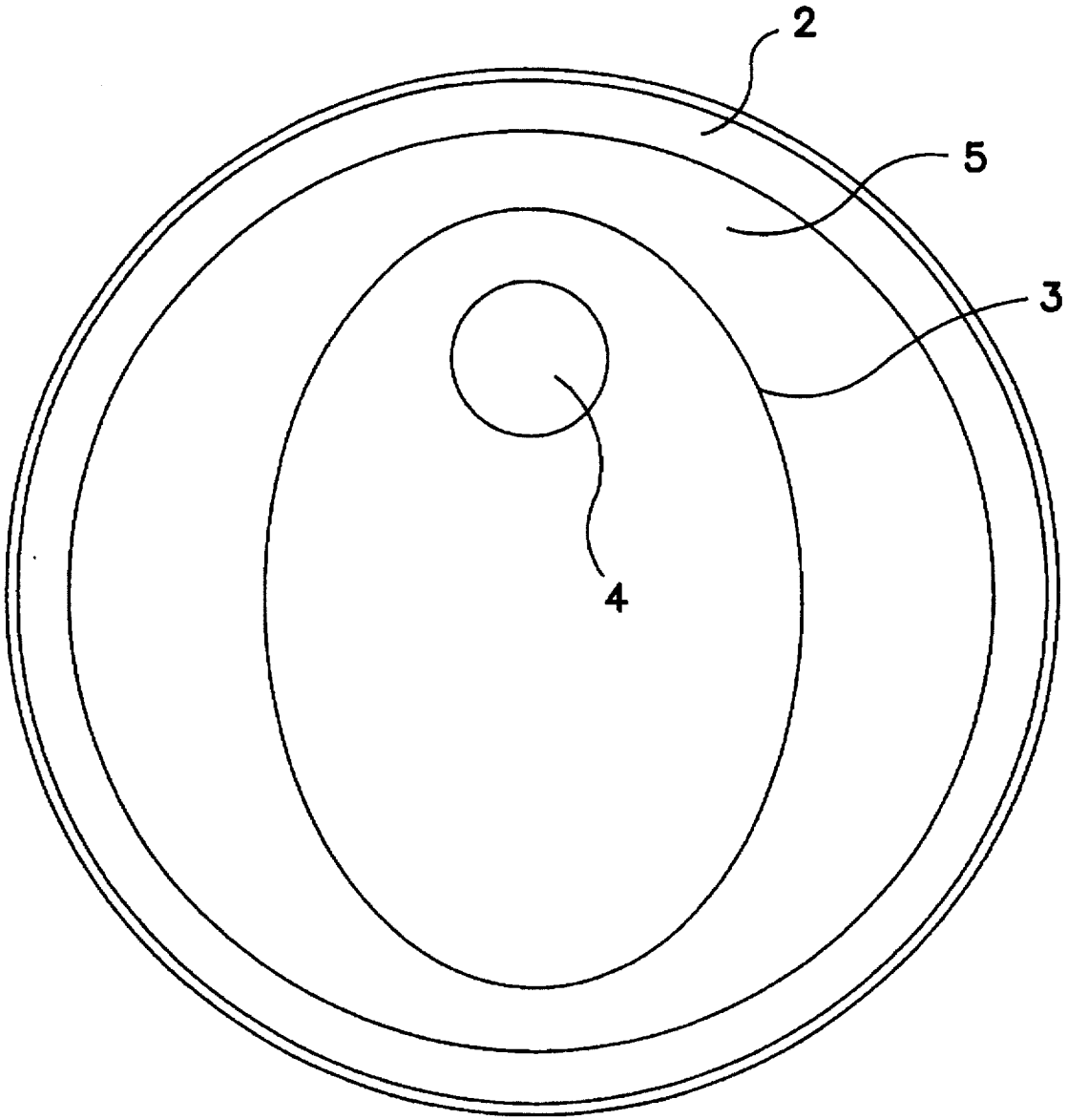
FIG. 4 shows a further version of a can base with an off-center projection.

In FIG. 4 the circular base rim 2 of a can 5 is shown in plan view. The response area is delimited by an endless oval depression 3 and the inward projecting bulge 4 is situated off center. When the internal pressure in such a can increases, the area bulging concave inwards is pressed outwards, usefully forming a convex bulge.

Figure 5:
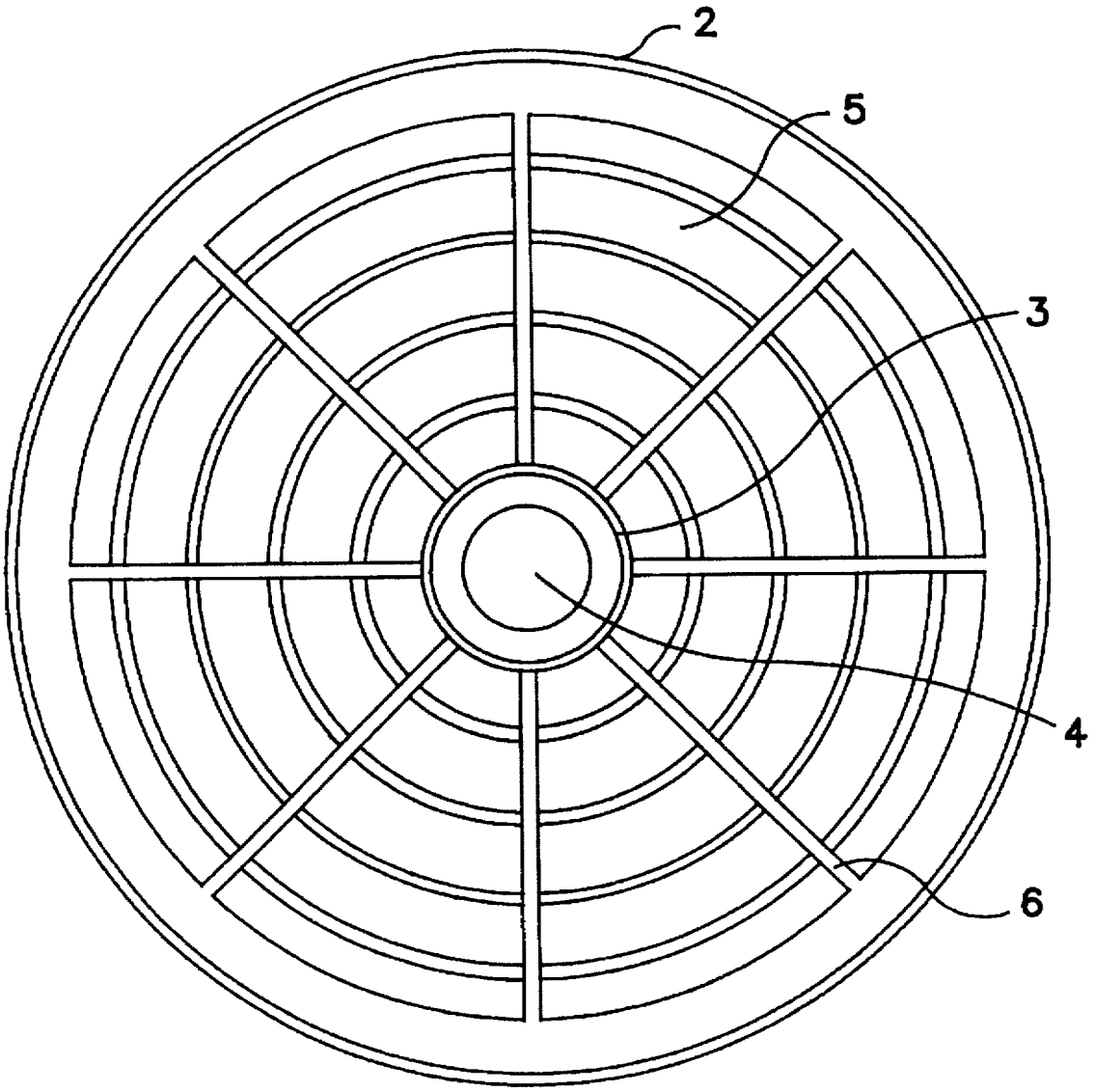
FIG. 5 shows the plan view of another version of a can base, the cross-section of which is shown in FIG. 1*c*.

FIG. 5 shows a further version of a can base 5. A concave response area domed inwards and surrounded by base rim 2 features a plurality of concentric ting-shaped depressions 3. In the center is a projection 4 and running out from the center in a star shape are further depressions 6. In cross-section such a can base may correspond to that shown in FIG. 1*c*.

Typical examples of cans that may find use in practice are e.g. two-part cans i.e. cans out of a lid and a one-piece base and side-wall which e.g. may have a capacity of 100 to 800 g. Cans with a capacity e.g. of 800 to more than 1200 g are preferably three-piece cans, i.e. cans comprising base, lid and side-wall. The lids may e.g. be easy-open lids which are notched and feature within the notch a pull-ting or are easy to open via an edge seam.

From FIGS. 1*a* to 1*c* it is easy to see that, due to the base bowing out slightly as a result of only a small increase in internal pressure, the projection 4 in the base makes contact with the underlying surface and causes the can to become unstable. The projecting bulge areas may be designed such that the required change in shape takes place, e.g. when the difference in pressure outside and inside the can amounts to 0.1 to 1 bar. Preferred are response values 0.2 to 0.7 bar. The change in bulge shape at the base viz., from concave to convex, should result in a height difference of at least 0.5 mm, usefully at least 1.0 mm between the projection 4 and the base rim 2 that the can is standing on.

We claim:

1. Gas-tight container which comprises: an outer shell surface selected from the group consisting (1) of metal, (2) metal and plastic, and (3) metal and cellulose-containing material, and the outer shell surface having a base, lid and at least one side-wall and is such that it features at least one response area which is surrounded by an endless depression and, when the container is in the condition for use, is concave in shape; a base rim of said base which rests along a linear or ring-shaped line of contact; wherein the response area is situated at the base of the container and includes a bulge which is concave in the useable form of the container which does not project beyond the outer limits of the base rim and, under increased pressure from within the can under normal external conditions, projects beyond the base rim, and such that the linear or ring-shaped contact the container makes with the underlying surface is replaced by two-point contact, and the resultant instability of the container indicates that its contents have undergone a chemical or physical change.

2. Gas-tight container according to claim 1, wherein within the response area which is surrounded by an endless depression, at least one further endless depression is provided.

3. Gas-tight container according to claim 1, wherein the response area which exhibits a concave bulge in the useable form of the container is the base and the side-wall is formed into a cylinder.

4. Gas-tight container according to claim 1, wherein there is a difference in volume between the initial condition in which the response area is concave, and the condition in which the response area is pushed out or forms a convex bulge and extends beyond the outer limits of the base rim under increased interior pressure.

5. Gas-tight container according to claim 4, wherein the difference in volume is up to 14 $cm^3$.

6. Gas-tight container according to claim 5, wherein the difference in volume is from 0.5 to 12 $cm^3$.

7. Gas-tight container according to claim 5, wherein the difference in volume is from 1 to 10 $cm^3$.

8. Gas-tight container according to claim 5, wherein the difference in volume is from 2 to 5 $cm^3$.

9. Gas-tight container according to claim 1, wherein the container shell is made of metal.

10. Gas-tight container according to claim 1, wherein the response area which is surrounded by an endless depression features at least one projection which, in the form in which the container is useable, does not extend beyond the outer limits of the base rim and, under increased internal pressure, does extend beyond the outer limits of the base rim, as a result of which the linear or ring-shaped contact the container base rim makes with a flat underlying surface becomes two-point contact.

11. Gas-tight container according to claim 1, wherein under normal internal pressure, the concave bulge does not extend beyond the outer limits of the base rim and under increased internal pressure the concave bulge is pressed into forming a convex bulge which extends beyond the outer limits of the base rim.

12. Gas-tight container according to claim 1, for substances that are subject to microbial and/or chemical decomposition.

13. Gas-tight container according to claim 1, for substances belonging to the category of foodstuffs for at least one of human and animal consumption.

* * * * *